US008726572B2

(12) United States Patent
Derham

(10) Patent No.: US 8,726,572 B2
(45) Date of Patent: May 20, 2014

(54) WINDOW RESTRICTOR

(71) Applicant: Mighton Products Limited, Saffron Walden (GB)

(72) Inventor: Michael Derham, Saffron Walden (GB)

(73) Assignee: Mighton Products Limited, Saffron Walden (GB)

( * ) Notice: Subject to any disclaimer, the term of this patent is extended or adjusted under 35 U.S.C. 154(b) by 0 days.

(21) Appl. No.: 13/627,341

(22) Filed: Sep. 26, 2012

(65) Prior Publication Data

US 2013/0082469 A1 Apr. 4, 2013

(30) Foreign Application Priority Data

Sep. 27, 2011 (GB) ..... 1116627.9
Apr. 30, 2012 (GB) ..... 1207500.8

(51) Int. Cl.
*E05B 65/10* (2006.01)

(52) U.S. Cl.
USPC ..... 49/141; 49/246; 49/394

(58) Field of Classification Search
USPC ..... 49/246, 247, 248, 141, 394; 292/262, 292/263, 265, 268, 270, 274, 278, DIG. 4
See application file for complete search history.

(56) References Cited

U.S. PATENT DOCUMENTS 2,175,861 A * 10/1939 Wall ..... 49/261
2,760,805 A * 8/1956 Stevens et al. ..... 49/356
2,811,349 A * 10/1957 Bondurant et al. ..... 49/324
2,863,182 A * 12/1958 Gabor ..... 49/261
3,509,663 A * 5/1970 Miller ..... 49/248
5,052,079 A * 10/1991 Vosskotter ..... 16/367
5,090,754 A 2/1992 Thompson
5,802,768 A * 9/1998 Hammer et al. ..... 49/325
8,418,404 B2 * 4/2013 Gramstad et al. ..... 49/141
2004/0128914 A1 * 7/2004 Hempelmann ..... 49/192
2011/0203184 A1 * 8/2011 Nguyen et al. ..... 49/400

FOREIGN PATENT DOCUMENTS

EP 0 164 522 12/1985
EP 2085546 A2 * 8/2009 ..... E05C 17/16
GB 2 243 648 11/1991
GB 2249128 A * 4/1992 ..... E05C 17/02
GB 2 279 104 12/1994
RU 2177531 12/2001

* cited by examiner

*Primary Examiner* — Jerry Redman
(74) *Attorney, Agent, or Firm* — Burr & Brown, PLLC

(57) ABSTRACT

A window restrictor that may be used to limit the opening of a window. The restrictor comprises a restrictor member and a latch mechanism. Typically, the restrictor member is attached to a stile or rail of the moving window pane and the latch mechanism is attached to a part of the casing or frame surrounding the window opening. In use, the restrictor member is engaged with the latch mechanism so that as the window is opened, the extent of opening is restricted by the restrictor member length. To fully open the window, the restrictor member is disengaged from the latch mechanism. When the restrictor member and latch mechanism are disengaged, they remain in such a configuration that, when the window is closed, the restrictor member and latch mechanism automatically re-engage to prevent the window being fully opened again. The restrictor member can comprise a hinged member which includes bias means.

33 Claims, 7 Drawing Sheets

WINDOW RESTRICTOR

FIELD OF THE INVENTION

This invention relates to a device for limiting or restricting the extent of opening of a window, and may be applicable to both sash and casement windows.

BACKGROUND TO THE INVENTION

There is a requirement to restrict the extent to which a sash or casement window can be opened, partly to prevent children opening a window beyond a certain distance so that they cannot fall out through the window, and partly from an anti-theft point of view, to prevent the window being opened from the outside.

However any such restrictor needs to be capable of being overridden when the window is to be fully opened by an adult, from the inside. Such an override mechanism needs to be easily and quickly operable by a user in an emergency but also needs to be complicated enough to prevent the easy operation by a child and to prevent the accidental operation by a person or animal.

It is an object of the present invention to overcome at least one problem associated with prior art devices whether referred to herein or otherwise.

SUMMARY OF THE INVENTION

According to a first aspect of the present invention there is provided a window restrictor for limiting an extent of opening of a window, the window restrictor comprising a restrictor member attachable to a first part of said window and a latch mechanism attachable to a second part of said window, the restrictor member comprising a first arm and a second arm, wherein the first arm comprises attachment means to rotatably attach the first arm to the first part of said window, the first arm being pivotally connected to the second arm and the second arm comprising a first locking means, the latch mechanism comprising second locking means for engagement with the first locking means, wherein, in use, when said first and second locking means are engaged, relative movement of said first and second window parts in a direction of opening is limited by said restrictor member, the window restrictor further comprising release means for disengaging said first and second locking means to enable the relative movement of said first and second window parts beyond a limit of the restrictor member and,-when disengaged, the first and second locking means are aligned to automatically re-engage as said window is closed and wherein the release means comprises a simultaneous dual action release mechanism comprising a first actuator and a second actuator and wherein the first actuator is operated by a first manual action and the second actuator is operated by a second independent manual action, and wherein the restrictor member comprises a spacer block in order to aid the latch mechanism and, in which, the spacer block is arranged to abut a part of the restrictor member and urge the first and second locking means to re-engage as the window is closed.

Preferably the first actuator must be manually held in a disengaged position to enable the second actuator to move from an engaged position to a disengaged position.

Preferably the first and second locking means are aligned to automatically re-engage when the first and second window parts are moved back to a reengagement position of the window restrictor. The reengagement position may comprise a position at which the two window parts are located closer to each other than the two window parts at the limited position.

Preferably a first end of the first arm comprises the attachment means for rotatable attachment of the first arm to the first part of said window.

Preferably the attachment means comprises biasing (or urging) means to bias (or urge) the first arm towards a rest position.

Preferably in the rest position the first arm is aligned with the first part of the window.

Preferably in the rest position the first arm is aligned with and parallel to the first part of the window.

Preferably the first arm and/or the second arm extend along respective longitudinal axes and wherein the or each longitudinal axis is parallel to the first part of the window in the rest position.

Preferably the first arm and/or the second arm extend along respective longitudinal axes and wherein the or each longitudinal axis is parallel to the first part of the window when the first and second locking means are disengaged.

Preferably the first arm and/or the second arm extend along respective longitudinal axes and wherein the or each longitudinal axis is parallel to the first part of the window when the first and second locking means are disengaged and the second part of the window is opened beyond the limit of the restrictor member.

Preferably the first arm and/or the second arm locate adjacent to and/or flush with a mounting surface of the first part of the window in the rest position.

Preferably the first arm and/or the second arm locate adjacent to and/or flush with a mounting surface of the first part of the window when the first and second locking means are disengaged.

Preferably the first arm and/or the second arm locate adjacent to and/or flush with a mounting surface of the first part of the window when the first and second locking means are disengaged and the second part of the window is opened beyond the limit of the restrictor member.

Preferably a second end of the first arm is pivotally connected by pivot means to a first end of the second arm.

Preferably the pivot means comprises biasing (or urging) means to bias (or urge) the second arm towards a rest position.

Preferably in the rest position the second arm is aligned with the first arm.

Preferably in the rest position the second arm is parallel with the first arm.

Preferably in the released and disengaged configuration, the first arm and the second arm are urged (or biased) into a position located adjacent to and/or flush with a mounting surface of the first part of the window. Preferably in the released and disengaged configuration, the first arm and the second arm are urged (or biased) into a position at which the first arm and the second arm do not project towards the second part of the window and/or do not extend into a space created by opening the window.

Preferably in the released and disengaged configuration, the first arm and/or the second arm are urged (or biased) towards a mounting surface of the first part of the window.

Preferably in the released and disengaged configuration, the first locking means is urged (or biased) into a position aligned with the second locking means such that subsequent movement of the window towards a closed position may cause the first locking means to be automatically engaged with the second locking means. Preferably this arrangement effectively resets the latching mechanism.

Preferably the pivot means comprises a hinge.

Preferably the first arm and the second arm form a hinged member.

Preferably a second end of the second arm comprises the first locking means.

Preferably said first and second locking means are disengaged to fully open the window.

Preferably the first and second arms are parallel to each other in the disengaged position.

Preferably the first and second arms are perpendicular to said direction of opening.

Preferably the first locking means is arranged to be aligned with the second locking means in the disengaged position.

Preferably the first locking means is arranged to be aligned with the second locking means when the first part of the window is open relative to the second part of the window and the locking means is disengaged.

Preferably the release means comprises an actuating mechanism enabling the disengagement of the first and second locking means to enable the relative movement of the first and second window parts beyond the limit of the restrictor member.

Preferably the actuating mechanism comprises a manually actuated mechanism.

The actuating mechanism may require a dual action in order to allow the disengagement of the first and second locking means.

The actuating mechanism may require a simultaneous pull movement and a push movement.

The actuating mechanism may comprise a sliding trigger.

The actuating mechanism may comprise a push button.

The actuating mechanism may require the simultaneous operation of the sliding trigger and the push button.

The actuating mechanism may require a first movement and simultaneous second movement.

Preferably, the second actuator is only operable once the first actuator has been operated. Preferably the first actuator must be held in a disengaged position to enable the second actuator to move from an engaged position to a disengaged position. More preferably the first actuator must be manually held in a disengaged position to enable the second actuator to move from an engaged position to a disengaged position.

The actuating mechanism may require a first actuator to be moved which then allows the movement of a second actuator (whilst the first actuator is manually held in a released position) which may then enable relative movement of the first and second window parts beyond the limit of the restrictor member.

Both of the dual actions required may be achieved by a single hand of a user. For example, the dual action release mechanism may comprise a first actuator and a second actuator. The first actuator and the second actuator may both be operable by a single hand of a user.

Preferably urging means are arranged to urge the first actuator towards the engaged position. Preferably the first actuator must be (manually) restrained against the urging means in the disengaged position.

Preferably urging means are arranged to urge the second actuator towards the engaged position. The second actuator may be (manually) restrained against the urging means in the disengaged position and this (manual) restraint may enable the first and second locking means to disengage.

The first locking means may comprise a locking lug which may be mounted on the second arm and preferably is mounted on (or towards) a free end of the second arm.

The second locking means may comprise a latching recess for receiving and retaining the first locking means.

The latching recess together with the latch mechanism may encapsulate the first locking means in an engaged configuration.

The latching recess may encapsulate the first locking means in an engaged configuration and prevents any translational movement of the first locking means relative to the latching recess in an engaged configuration. The first locking means may be rotatable relative to the latching recess in an engaged configuration.

The latching recess may comprise a partially circular opening.

The latching recess may be provided on a latching plate. The latching plate may be rotatable between a first position and a second position. Preferably in the first position the latching plate prevents removal of the first locking means from the second locking means. Preferably in the second position the first locking means is removable from the second locking means.

The latching plate may be manually movable between the first position and the second position.

The latching plate may be movable between the first position and the second position by bias or urging means which may comprise a spring.

The latching plate may be manually movable between the first position and the second position by an actuating member.

The latching plate may be lockable in the first position.

The first window part may be pivotally movable to the second window part.

The first window part may be slidably movable to the second window part.

The window may comprise a casement window.

The window may comprise a sash window.

The extent of the initial opening of the window may be limited to a linear length of the first arm and the second arm.

Preferably the relative movement (or separation) of the first and second window parts in a direction of opening is limited to a length of the restrictor member.

Preferably the relative movement (or separation) of the first and second window parts in a direction of opening is limited to a length of the first arm and the second arm. Preferably the relative movement (or separation) of the first and second window parts in a direction of opening is limited to the length of the first arm and the second arm when the arms are aligned along a longitudinal axis.

Preferably the window restrictor bridges a predetermined distance when under tension such that the first and second parts of the window are prevented (or inhibited) from being opened further than this predetermined distance.

Preferably, in use, the first arm and the second arm are arranged to bridge a predetermined distance when under tension such that the first and second parts of the window are prevented (or inhibited) from being opened further than this predetermined distance.

Preferably, when the window restrictor is in a disengaged configuration, the first and second parts of the window are openable to a greater distance than the predetermined distance.

Preferably when the window restrictor is disengaged the first locking means and the second locking means are aligned such that as the window parts are closed the window restrictor is (automatically) reengaged without user intervention.

Preferably when the window restrictor is disengaged the first locking means and the second locking means are aligned such that as the second part of the window is closed to a predetermined reengaging position the window restrictor is (automatically) reengaged without user intervention. Preferably the predetermined reengaging position comprises a position at which first window part is located adjacent to the second window part.

The first arm may comprise a first portion and a second portion wherein the first portion is longitudinally offset from the second portion.

Preferably the first arm includes a stepped portion between the first portion and the second portion.

The first part of the window may comprise a stile or a rail of a movable window pane.

The second part of the window may comprise a part of a casing or frame of a window opening.

Preferably the window restrictor is arranged to limit the extent of opening of a sash hingedly coupled to a window frame.

Preferably the window comprises a sash hingedly coupled to a window frame.

Preferably the first part of the window comprises a sash which is hingedly coupled to a window frame.

Preferably the second part of the window comprises a window frame to which a sash is hingedly coupled.

Preferably when the window is in a closed position the locking means is engaged. Preferably when the window is in a closed position the first locking means is encapsulated within the second locking means. Preferably when the window is in a closed position the first locking means is prevented from moving translationally relative to the second locking means.

Preferably, as the window is opened from the closed position the first locking means solely rotates and is prevented from translational movement relative to second locking means and/or the second window part.

Preferably, as the window is opened from the closed position the second locking means remains stationary relative to the second window part.

The window restrictor may comprise a spacer block in order to aid the latch mechanism.

The window restrictor may comprise a spacer block which is arranged to abut a part of the restrictor member as the first and second locking means are re-engaged as the window is closed.

The window restrictor may comprise a spacer block which is arranged to abut a part of the restrictor member as the first and second locking means are re-engaged as the widow is closed.

The spacer block may abut the restrictor member and urge the first and second locking means to re-engage.

The spacer block may be removable. The spacer block may be replaceable with a different spacer block in order for the window restrictor to fit the window.

According to a second aspect of the present invention there is provided a window assembly including a window and a window restrictor for limiting an extent of opening of said window, the window restrictor comprising a restrictor member attachable to a first part of said window and a latch mechanism attachable to a second part of said window, the restrictor member comprising a first arm and a second arm, wherein the first arm comprises attachment means to rotatably attach the first arm to the first part of said window, the first arm being pivotally connected to the second arm and the second arm comprising a first locking means, the latch mechanism comprising second locking means for engagement with the first locking means, wherein, in use, when said first and second locking means are engaged, relative movement of said first and second window parts in a direction of opening is limited by said restrictor member, the window restrictor further comprising release means for disengaging said first and second locking means to enable the relative movement of said first and second window parts beyond a limit of the restrictor member and, when disengaged, the first and second locking means are aligned to automatically re-engage as said window is closed and wherein the release means comprises a simultaneous dual action release mechanism comprising a first actuator and a second actuator and wherein the first actuator is operated by a first manual action and the second actuator is operated by a second independent manual action, and wherein the restrictor member comprises a spacer block in order to aid the latch mechanism and. in which, the spacer block is arranged to abut a part of the restrictor member and urge the first and second locking means to re-engage as the window is closed.

According to a third aspect of the present invention there is provided a method of limiting an extent of opening of a window with a window restrictor, the method comprising attaching a restrictor member to a first part of said window and attaching a latch mechanism to a second part of said window, the restrictor member comprising a first arm and a second arm, wherein the first arm comprises attachment means to rotatably attach the first arm to the first part of said window, the first arm being pivotally connected to the second arm and the second arm comprising a first locking means, the latch mechanism comprising second locking means for engagement with the first locking means, wherein, in use, when said first and second locking means are engaged, relative movement of said first and second window parts in a direction of opening is limited by said restrictor member, the method further comprising providing release means for disengaging said first and second locking means to enable the relative movement of said first and second window parts beyond a limit of the restrictor member and, when disengaged, the first and second locking means are aligned to automatically re-engage as said window is closed and wherein the release means comprises a simultaneous dual action release mechanism comprising a first actuator and a second actuator and wherein the first actuator is operated by a first manual action and the second actuator is operated by a second independent manual action, and wherein the restrictor member comprises a spacer block in order to aid the latch mechanism and, in which, the spacer block is arranged to abut a part of the restrictor member and urge the first and second locking means to re-engage as the window is closed.

According to a fourth aspect of the present invention there is provided a window restrictor for limiting the extent of opening of a window, the window restrictor comprising a restrictor member attachable to a first part of a window and a latch mechanism attachable to a second part of the window, the restrictor member comprising an arm, wherein the arm comprises attachment means to rotatably attach the arm to the first part of the window, the arm comprising a first locking means, the latch mechanism comprising second locking means for engagement with the first locking means, wherein, in use, when said first and second locking means are engaged, relative movement of said first and second window parts in a direction of opening is limited by said restrictor member, the window restrictor further comprising release means for disengaging said first and second locking means to enable the relative movement of said first and second window parts beyond the limit of the restrictor member and, when disengaged, the first and second locking means are aligned to automatically re-engage as the window is closed and wherein the release means comprises a simultaneous dual action release mechanism comprising a first actuator and a second actuator and wherein the first actuator is operated by a first manual action and the second actuator is operated by a second independent manual action.

According to a fifth aspect of the present invention there is provided a window assembly including a window and a window restrictor for limiting the extent of opening of the window, the window restrictor comprising a restrictor member attachable to a first part of a window and a latch mechanism attachable to a second part of the window, the restrictor member comprising an arm, wherein the arm comprises attachment means to rotatably attach the arm to the first part of the window, the arm comprising a first locking means, the latch mechanism comprising second locking means for engagement with the first locking means, wherein, in use, when said first and second locking means are engaged, relative movement of said first and second window parts in a direction of opening is limited by said restrictor member, the window restrictor further comprising release means for disengaging said first and second locking means to enable the relative movement of said first and second window parts beyond the limit of the restrictor member and, when disengaged, the first and second locking means are aligned to automatically re-engage as the window is closed and wherein the release means comprises a simultaneous dual action release mechanism comprising a first actuator and a second actuator and wherein the first actuator is operated by a first manual action and the second actuator is operated by a second independent manual action.

According to a sixth aspect of the present invention there is provided a method of limiting the extent of opening of a window with a window restrictor, the method comprising attaching a restrictor member to a first part of the window and attaching a latch mechanism to a second part of the window, the restrictor member comprising an arm, wherein the arm comprises attachment means to rotatably attach the arm to the first part of the window, the arm comprising a first locking means, the latch mechanism comprising second locking means for engagement with the first locking means, wherein, in use, when said first and second locking means are engaged, relative movement of said first and second window parts in a direction of opening is limited by said restrictor member, the method further comprising providing release means for disengaging said first and second locking means to enable the relative movement of said first and second window parts beyond the limit of the restrictor member and, when disengaged, the first and second locking means are aligned to automatically re-engage as the window is closed and wherein the release means comprises a simultaneous dual action release mechanism comprising a first actuator and a second actuator and wherein the first actuator is operated by a first manual action and the second actuator is operated by a second independent manual action.

BRIEF DESCRIPTION OF THE DRAWINGS

The invention will now be further described, by way of example, with reference to the accompanying drawings, in which.

DESCRIPTION OF THE PREFERRED EMBODIMENTS

Figure 1:
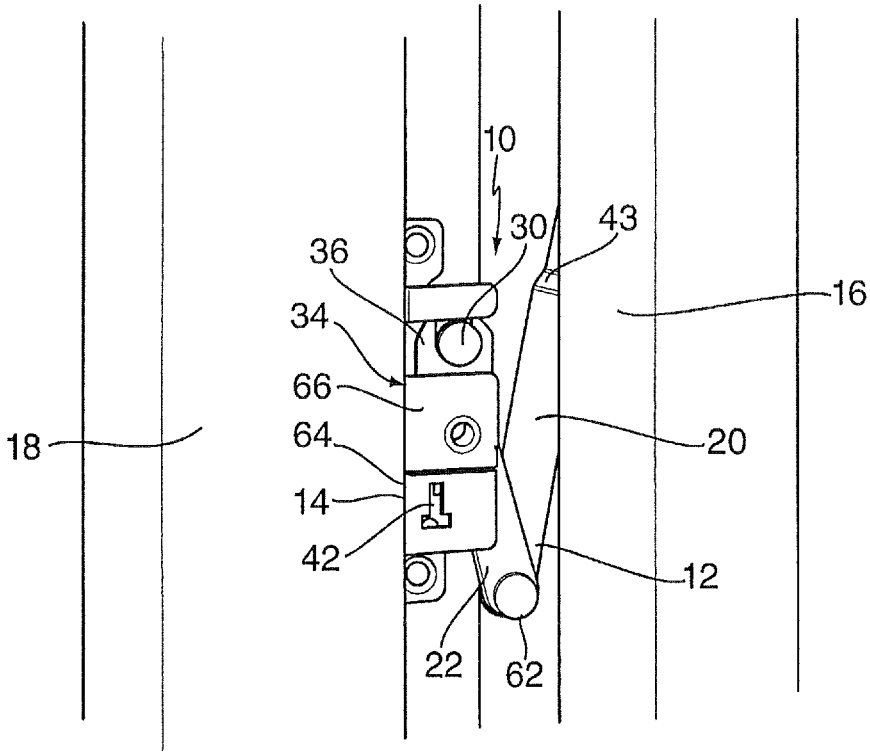
FIG. 1 shows a window in a first, partially open position with an embodiment of the window restrictor of the present invention in an engaged position.
Figure 2:
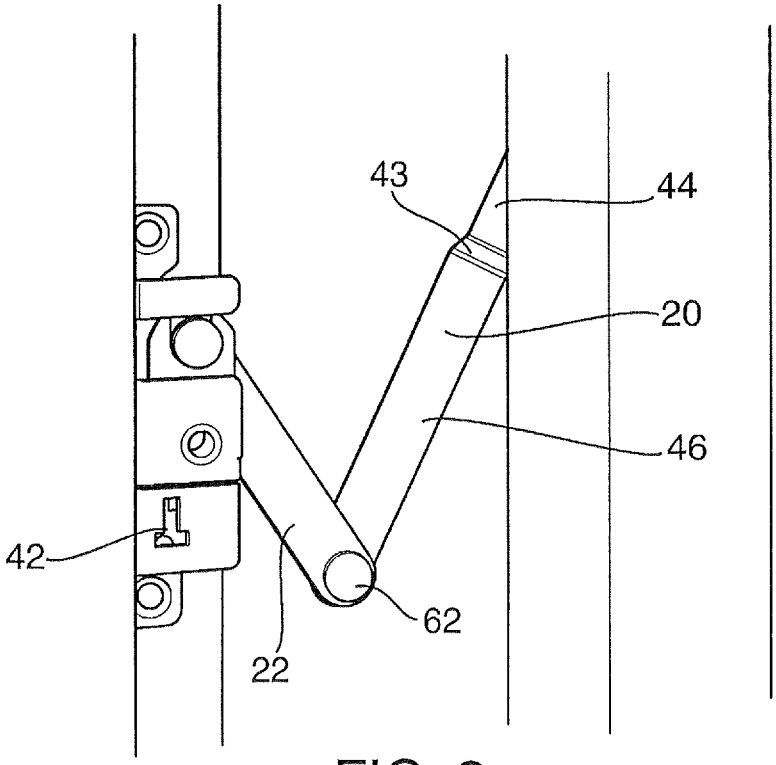
FIG. 2 shows the window restrictor of FIG. 1, with the window in a second, partially open position.

As shown in FIGS. 1 to 5, the window restrictor 10 of the present invention may be used to limit the opening of a sash (sliding) window or a casement (hinged) window. The restrictor 10 comprises a restrictor member 12 and a latch mechanism 14. Typically, the restrictor member 12 is attached to a stile or rail 16 of the moving window pane and the latch mechanism 14 is attached to a part of the casing or frame 18 surrounding the window opening. In alternative embodiments the restrictor member 12 may be attached to the frame 18 and the latch mechanism 14 may be attached to the rail 16.

In use, the restrictor member 12 is engaged with the latch mechanism 14 so that as the window is opened, the extent of opening is restricted by the length of the restrictor member 12. To fully open the window, the restrictor member 12 must be disengaged from the latch mechanism 14.

A main advantage of the restrictor 10 of the present invention is that, when the restrictor member 12 and latch mechanism 14 are disengaged, they remain in such a configuration that, when the window is closed, the restrictor member 12 and latch mechanism 14 automatically re-engage to prevent the window being fully opened again. This means that it is not necessary to remember to reattach or reset the restrictor 10 each time the window is opened and closed.

Figure 5:
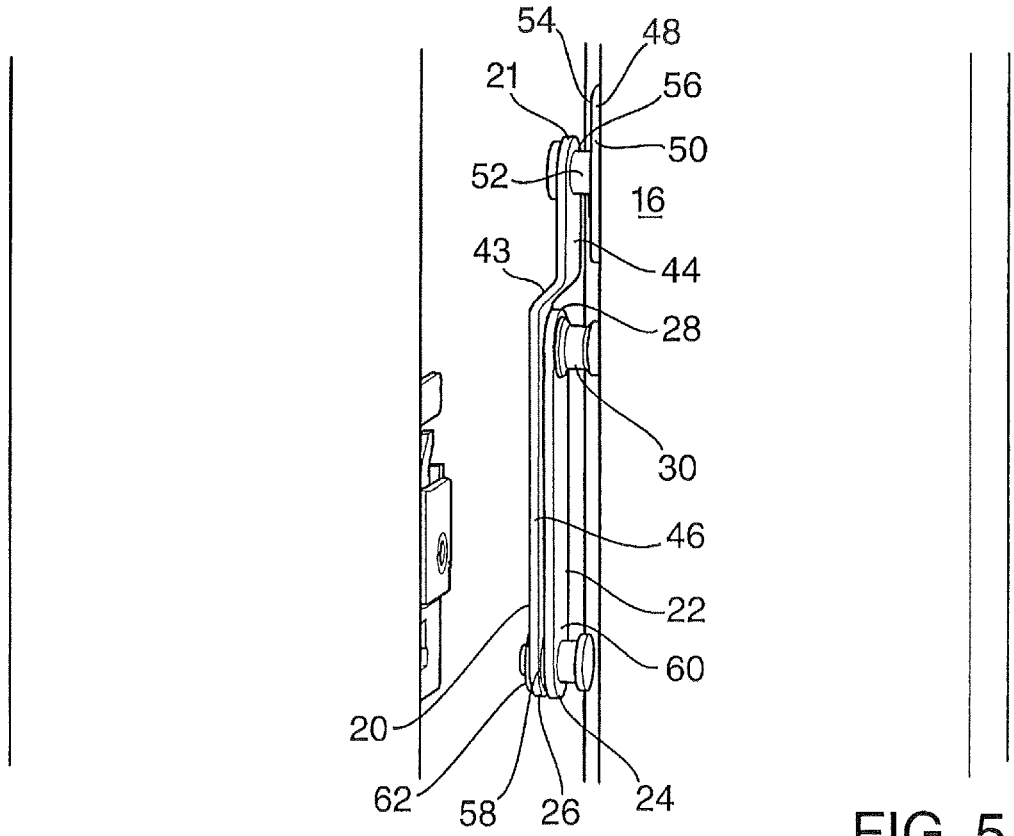
FIG. 5 is a further view of the restrictor of FIG. 4 in its disengaged configuration.
Figure 6:
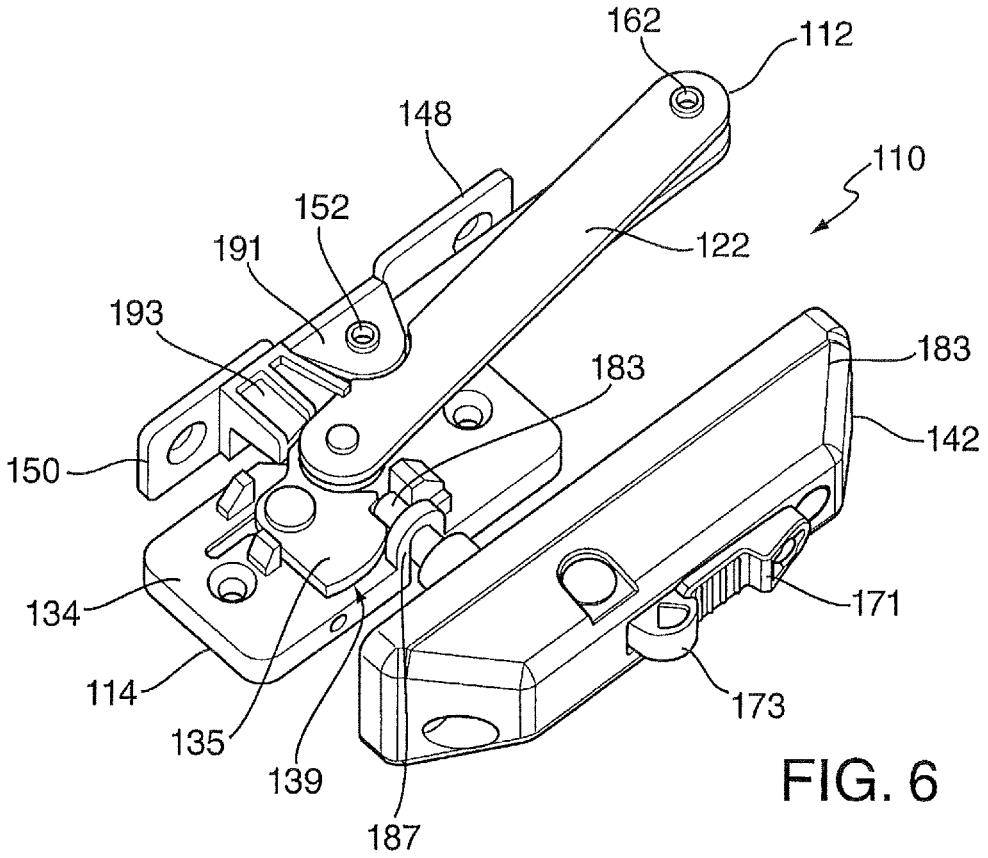
FIG. 6 is a perspective view of a window restrictor according to a second embodiment of the present invention, with the restrictor in an engaged position.

FIG. 1 shows the window restrictor 10 in an engaged position, with the window slightly open. The restrictor member 12 includes an elongate first arm 20 which is pivotally attached at a first end 21 to the rail 16 of the window pane, as shown in FIG. 5. An elongate second arm 22 of the restrictor member 12 extends from and is pivotally connected at its first end 24 to the second end 26 of the first arm 20. A second end 28, or free end, of the second arm 22 terminates in a latch pin 30, which forms a first part of locking means 32 of the restrictor 10.

The latch mechanism 14 includes a housing 34 and a latch plate 36. The latch plate 36 is rotatably attached to the housing 34 and includes a slot 38 in a first end 40 of the plate 36 which forms a second part of the locking means 32. A trigger, or release mechanism 42 is arranged to engage with the latch plate 36 to prevent rotation of the plate 36 relative to the housing 34 and to selectively disengage the latch mechanism 14, as will be described in more detail below.

In this embodiment, the first and second arms 20, 22 are formed from flat bars. The first arm 20 is bent part way along its length to form a step 43 in the arm 20, thereby forming a shorter first portion 44 at the first end 21 of the arm 20 and a longer second portion 46, offset from but parallel to the first portion 44, at the second end 26 of the arm 20. The length of the second arm 22 is substantially the same as the length of the second portion 46 of the first arm 20.

The restrictor member 12 is attached to the rail 16 of the window by attachment means 48 including a base plate 50, fixed to the rail 16 with screws (not shown) or similar fixing means, and a spindle 52 projecting from a front face 54 of the base plate 50. A hole 56 through the first portion 44 of the first arm 20, proximate the first end 21, is sized to receive the spindle 52 so that the arm 20 may be rotatably attached to the window rail 16. The step 43 in the first arm 20 means that a gap between the second portion 46 and the rail 16 is greater than a gap between the first portion 44 and the rail 16.

Two further holes 58, 60 are formed through the second end 26 of the first arm 20 and the first end 24 of the second arm 22. A pivot pin 62 extends through the aligned holes 58, 60 and is secured in place so that the first and second arms 20, 22 are able to rotate with respect to each other about the pivot pin 62.

Figure 4:
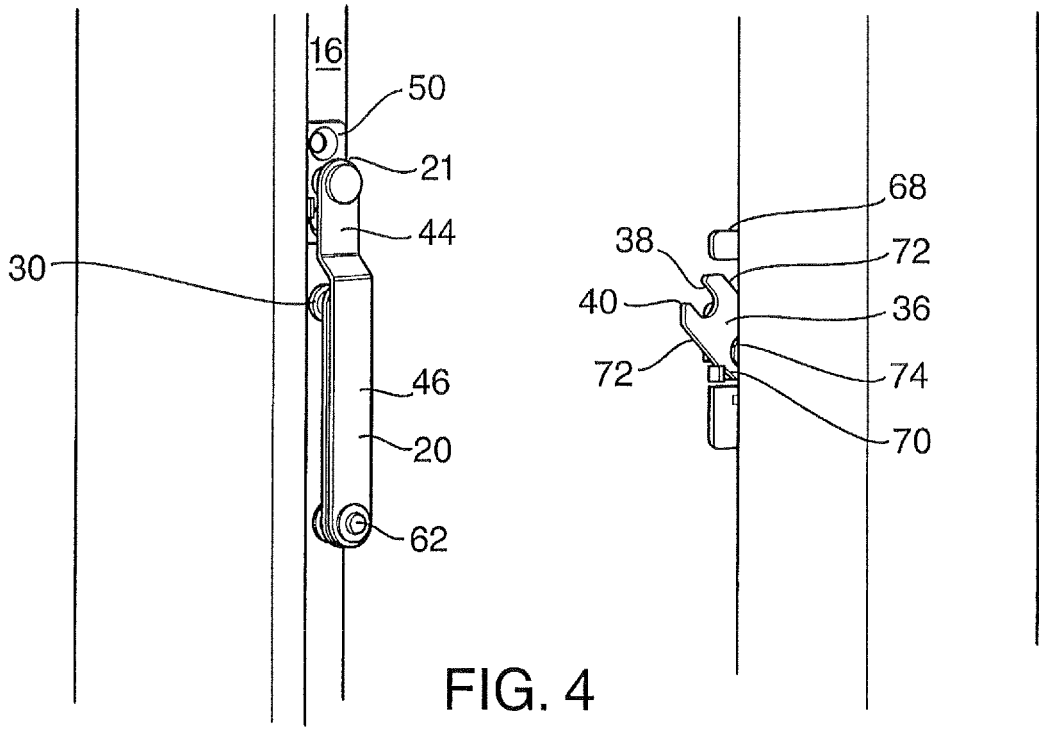
FIG. 4 shows the restrictor of FIG. 1 disengaged such that the window is opened further than the limited extent shown in FIG. 3.

In a disengaged (retracted), or closed, position, as shown in FIGS. 4 and 5, the first and second arms 20, 22 are oriented so that they are parallel to each other and the second arm 22 extends along the second portion 46 of the first arm 20. In this position, the second arm 22 is located between the first arm 20 and the rail 16. Accordingly, when disengaged, the restrictor member 12 locates adjacent to and flush with the stile 16 of the window pane.

The latch pin 30 extends perpendicularly from a face of the second arm 22 so that the latch pin 30 locates between the second arm 22 and the rail 16 when the restrictor member 12 is in the disengaged (retracted) position.

The housing 34 of the latch mechanism 14 includes a first end portion 64 housing the release mechanism 42, a central portion 66 housing the latch plate 36 and a second end portion 68. In this embodiment, the latch mechanism 14 is fixed to the window frame 18 by screws (not shown) passing through holes at each end of the housing 34; however, the latch mechanism 14 may, alternatively, be fixed to the window frame 18 by any suitable means.

The latch plate 36 has a generally rectangular shape with two opposing ends 40, 70 and two side edges 72. As described previously, a slot 38 is formed in the first end 40 of the plate 36 extending towards the second end 70. The width and depth of the slot 38 is dimensioned to receive the latch pin 30 of the restrictor member 12. As such, when the locking means 32 is engaged the latch pin 30 is located in the slot 38 so that a longitudinal axis of the pin 30 is perpendicular to the plane of the latch plate 36.

The latch plate 36 is rotatably mounted to the housing 34 at a pivot 74 towards the second end 70 of the plate 36, and, in use, the latch plate 36 is rotatable between an engaged, or locked, position and a disengaged, or unlocked, position. In particular, a spring (not shown) urges the latch plate 36 outwardly when released by the release mechanism 42.

In the locked position, the first end 40 of the latch plate 36 is adjacent the second end portion 68 of the housing, so that this portion of the housing forms a retaining member 68 preventing the latch pin 30 from being withdrawn from the slot 38. The latch pin is rotatable within the slot 38 but the latch pin 30 cannot move in a translational direction.

Figure 3:
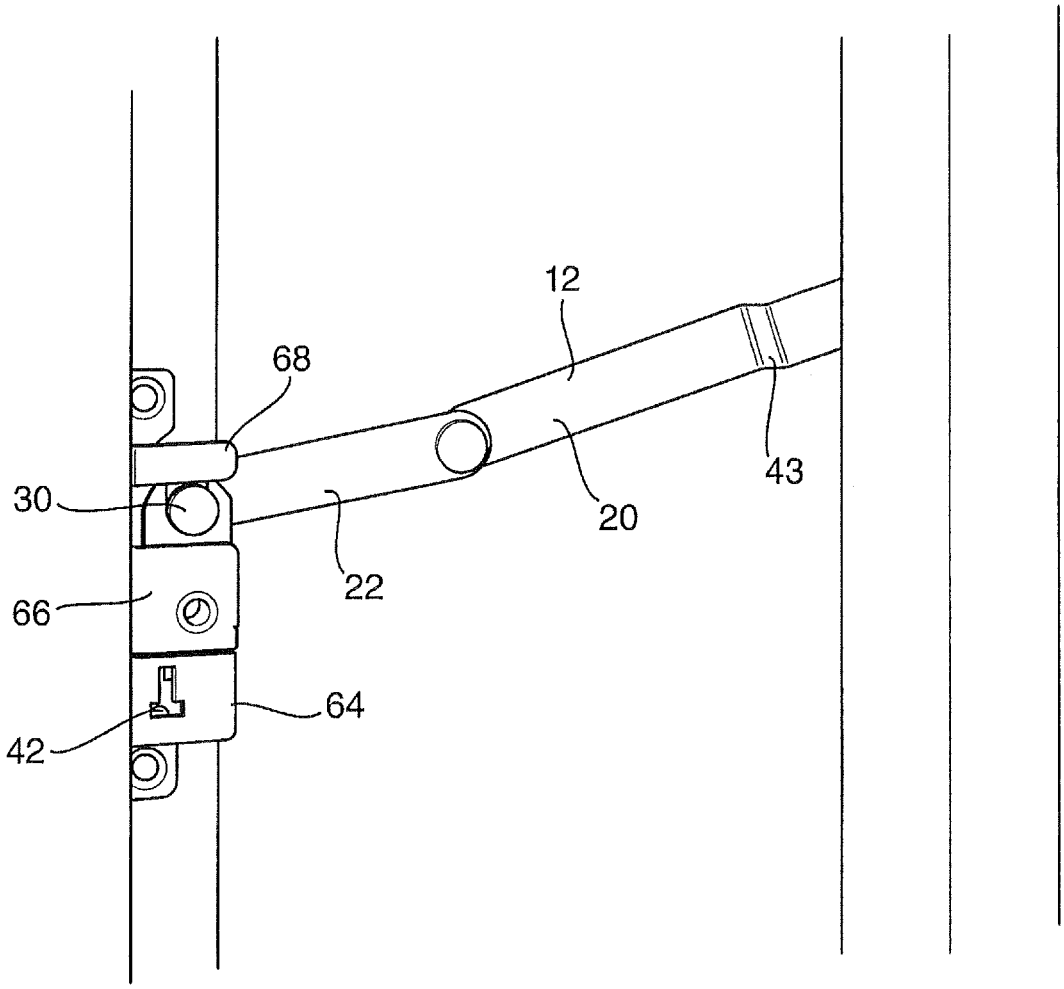
FIG. 3 shows the window restrictor of FIG. 1, with the window open to its full limited extent with the restrictor in an engaged position.

With the latch pin 30 retained by the latch mechanism 14, the length of the restrictor member 12 limits the extent to which the window may be opened. In particular, the first and second arms 20, 22 rotate about the attachment means 48 and the pivot pin 62 until the arms 20, 22 lie linearly or in a straight line, as shown in FIG. 3.

In the unlocked position, the latch plate 36 rotates so that the first end 40 of the latch plate 36 is rotated away from the retaining member 68 and no part of the housing 34 blocks the end of the slot 38. The latch pin 30 is then able to be removed from the slot 38 to disengage the restrictor member 12 from the latch mechanism 14.

The release mechanism 42 comprises a dual action mechanism and any such suitable mechanism may be used. In particular, the release mechanism may comprise a push button and a slidably mounted trigger within the end portion 64 of the housing 34. Accordingly, the release mechanism requires two distinct actions or two distinct motions.

The release mechanism 42 comprises a stop that prevents the latch (or catch) plate 36 rotating when in the closed (locked) position. The release mechanism 42 may also include a button and/or lever that when activated will pull the stop away and the latch (catch) plate 36 will then spring into the open (unlocked) position.

When a user wishes to disengage the latch mechanism 14 and rotate the latch plate 36 from the locked to the unlocked position as described above, the user presses the button and slides it towards the central portion 66 of the housing 34. This releases a pawl and enables a spring to urge the latch plate 36 outwardly.

The latch (catch) plate 36 is held on a sprung pivot and when the release mechanism is activated by the user the latch (catch) plate 36 will rotate to 45 degrees. The two arms 20, 22 are sprung in the centre and the sash pivot end. Then with the latch (catch) plate 36 in the open position, the arms are released and will spring into position on the opening sash 16.

Accordingly, the release mechanism comprises a dual action release mechanism that requires two actuators to be operated/activated at the same time (simultaneous). The term simultaneous means that both the slidable trigger 171 and the push button 173 are activated at the same time and that a user must operate both actuators 171, 173 at the same time, i.e. the user may be operating two buttons at a point in time (simultaneously).

The release mechanism requires a first manual action and a second independent manual action. Specifically, each actuator requires a manual action and the second actuator is not simply automatically operated by the first actuator and the two actuators do not form part of a chain of an actuating mechanism.

This does not mean that both actuators must be moved or be moving at the same time and/or have the same movement start and finish time but it requires that a user must by physically activating both actuators/buttons at the same time. This prevents one actuator being left permanently in an unengaged position which would effectively reduce the restrictor to a single action release mechanism rather than a dual action release mechanism.

Upon closing the sash 16, the bobbin 30 on the second arm 22 will engage with the latch (catch) plate 36 and push it back towards the 0 degree position. There is a pawl that acts upon the latch (catch) plate 36 such that when it is in the 0 degree position it will engage and lock the latch (catch) plate 36 in the 0 degree position.

With the latch (catch) plate 36 locked in the 0 degree position the bobbin 30 is held captive in the latch (catch) assembly and thus the movement of the sash 16 is limited by the extent of the arms 20, 22.

When the latch mechanism 14 is in the unlocked position, the user can remove the latch pin 30 from the slot 38, thereby separating (or disengaging) the latch mechanism 14 and restrictor member 12. The window can then be opened as far as desired. The latch mechanism 14 remains in the unlocked position until the window is closed again, as described below.

In a preferred embodiment, the restrictor member 12 includes biasing means to return the first and second arms 20, 22 to the disengaged (closed) position described above. Preferably a first biasing means is located between the first and second arms 20, 22 proximate the pivot pin 62 and a second biasing means is located between the first arm 20 and the window rail 16 proximate the attachment means 48 such that the two arms 20, 22 are sprung in the centre and at a sash pivot end. When the latch plate 36 is in the unlocked position, the latch pin 30 is released from the latch plate 36 and the arms 20, 22 are released and will spring into a closed position on the rail 16 of the opening sash or casement window. In other embodiments, the restrictor member 12 may be manually moved to the disengaged position by the user.

As the window is closed, the location of the latch pin 30 in the disengaged (closed) position is such that it is aligned with the slot 38 in the latch plate 36. Therefore, as the window is closed, the latch pin 30 automatically engages in the slot 38 and the continued movement of the window rail 16 towards the window frame 18 causes the latch plate 36 to rotate around the pivot 74 and return to the locked position. Rotation of the latch plate 36 also causes the release mechanism 42 to be returned to its initial position furthest from the central portion 66 of the housing 34. In particular, the movement pushes the latch plate 36 back towards the 0 degree position and returns it to the locked position.

The rotation of the latch plate 36 also causes the release mechanism 42 to be returned to its initial position furthest from the central portion 66 of the housing 34. In particular, the pawl that acts upon the latch plate 36 again engages with the latch plate 36 and locks the latch plate 36 in the 0 degree position.

With the latch plate 36 automatically locked in the 0 degree position upon closure of the window, the latch pin 30 is held captive in the latch assembly so that the restrictor member 12 is engaged with the latch mechanism 14. Thus the movement of the window is again limited by the extent of the arms 20, 22 of the restrictor member 12 as described above.

A second embodiment of the window restrictor 110 is shown in FIGS. 6 to 11. The window restrictor 110 of the second embodiment is similar to the window restrictor 10 of the first embodiment described above and, as such, similar or identical features have been indicated by reference numerals incremented by 100.

The window restrictor 110 comprises a restrictor member 112, a latch mechanism 114 and a release mechanism 142. As described above, the restrictor member 112 comprises an elongate first arm 120, pivotally connected to an elongate second arm 122. A first end 121 of the first arm 120 is pivotally attached to attachment means 148, which may, in turn, be rigidly fixed to a rail of a window (not shown).

The attachment means 148 comprises a base plate 150 and a tab or flange portion 191 that protrudes perpendicularly from one edge of the base plate 150. A spindle 152 pivotally connects the first arm 120 to the tab 191. A spacer block 193 is attached to the base plate 150, adjacent to the tab 191, and extends from the base plate 150 in the same direction as the tab 191. The spacer block 193 limits the extent of rotation of the first arm 120 so that the first arm 120 rotates through approximately 90° between the base plate 150 and the spacer block 193. The spacer block 193 also provides a stop against which the second arm 122 rests when the restrictor member 112 is in a closed position, as shown in FIGS. 6, 7, 10 and 11.

A latch pin 130 provided at the second end 128 of the second arm 122 engages with a latch plate 136 of the latch mechanism 114. The latch plate 136 comprises a generally triangular first portion 137 that is pivotally connected to the latch mechanism housing 134. The first portion 137 comprises a cam surface 139 along one edge of the plate 136 and a notch 141 formed in the edge proximate a first end of the cam surface 139. A second elongate portion 145 of the latch plate 136 extends from a second edge 147 of the first portion 137. In this way an L-shaped recess 107 is formed between the second edge 147 of the first portion 137 and an edge 149 of the second portion 145.

Figure 10:
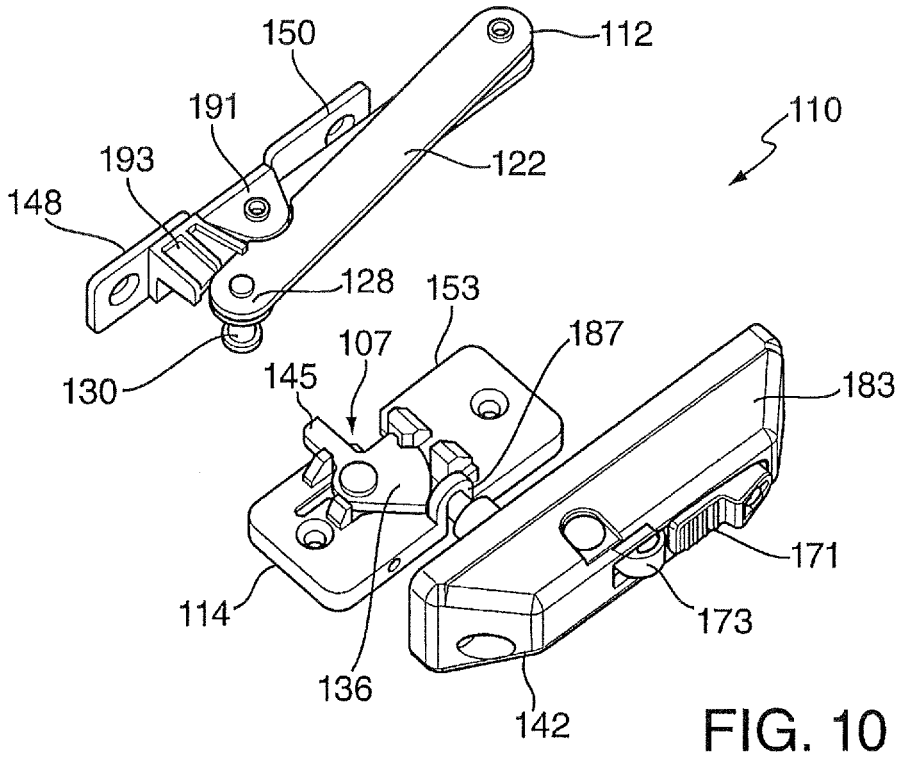
FIG. 10 is a perspective view of the window restrictor of FIG. 6, with the restrictor in a disengaged position.
Figure 11:
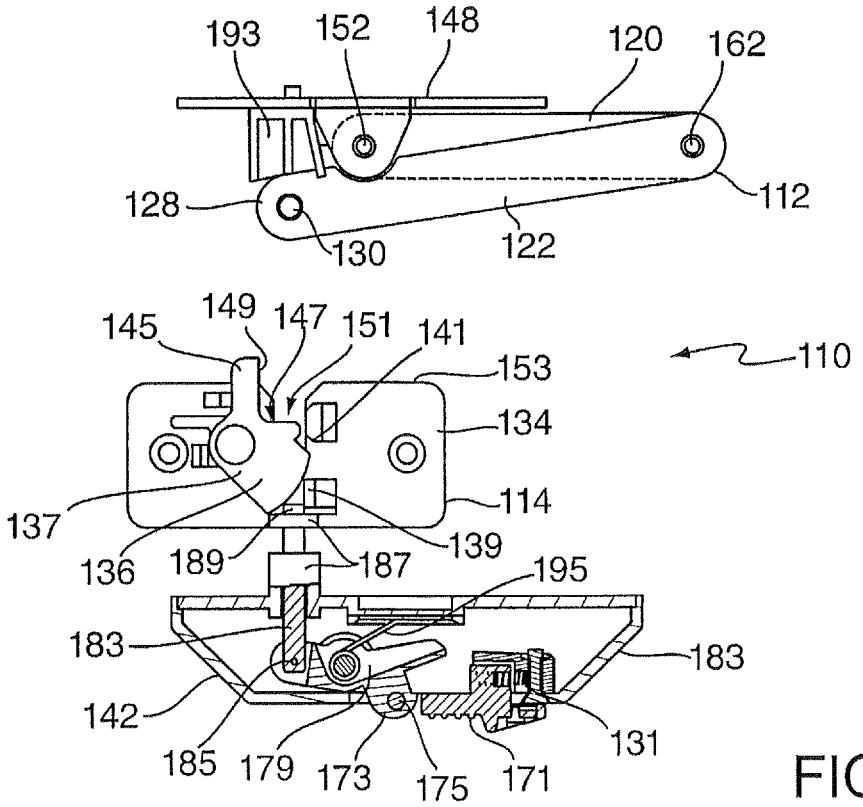
FIG. 11 is a partial cross-sectional view of the window restrictor of FIG. 10, with the restrictor in the disengaged position.

The housing 134 also includes a slot 151 formed in an edge 153 of a base plate 155, shown most clearly in FIGS. 10 and 11. The width of the slot 151 is such that the latch pin 130 may be received within the slot 151 when the restrictor member 112 is engaged with the latch mechanism 114.

The latch plate 136 rotates between an unlocked position in which the recess 107 is aligned with the slot 151 such that the latch pin 130 may be received within and withdrawn from the slot 151, and a locked position in which the second portion 145 extends across the slot 151 thereby preventing the latch pin 130 being withdrawn from the slot 151. Preferably the latch plate 136 is biased in the unlocked position by a spring (not shown) or other suitable biasing means.

A release mechanism 142 comprises a slidably mounted trigger or slider 171 and a push button 173 that must be simultaneously activated by a user in order to disengage the restrictor member 112 from the latch mechanism 114.

As above, the term simultaneous means that both the slidable trigger 171 and the push button 173 are activated (or are being activated) at the same time (simultaneously) and that a user must operate both actuators 171, 173 at the same time. This does not mean that both actuators must be moved at the same time and/or have the same movement start and finish time but it requires that a user must by physically activating both buttons at the same time. In this embodiment, the slidable trigger 171 is moved against urging means and a user must restrain and manually hold the slidable trigger against the force of the urging means which urges the slidable trigger towards the rest/engaged/locked position. Whilst the slidable trigger is held in the disengaged position against the urging means a user manually pushes the button 173 against associated urging means. Accordingly, in one embodiment, both the push button 173 and the slidable trigger 171 have associated urging means which urge the respective actuator 171, 173 towards the rest/engaged/locked position. This thereby means that the slidable button could not be permanently held in the disengaged position which would result in the release means being a single action system which would not prevent or inhibit a small child from easily operating the window restrictor. This prevents one actuator being left permanently in an unengaged position which would effectively reduce the restrictor to a single action release mechanism rather than a dual action release mechanism.

Accordingly, as in the first embodiment, the release mechanism requires a simultaneous dual action. In particular, a first end 175 of the slider 171 engages with an indent 177 in the button 173 so that a user must move the slider 171 in a direction away from the button 173, against the action of a spring 131 or other biasing/urging means, before the button 173 can be depressed.

The push button 173 is attached to, and in this embodiment is integrally formed with, a lever 179. The lever 179 is rotatably connected to a housing 183 of the release mechanism 142 via a spindle 181 located through a central portion of the lever 179. The button 173 is attached to the lever 179 on a first side of the spindle 181, and a locking pin 183 is attached at a first end 185 to the lever 179 on the opposite side of the spindle 181.

The locking pin 183 is retained within guide means 187 and the first end 185 is rotatably connected to the lever 179 so that as the lever 179 rotates about the spindle 181, the locking pin 183 moves linearly and in a reciprocating motion through the guide means 187. A second end 189 of the locking pin 183 engages with the notch 141 in the latch plate 136.

The lever 179 is biased, by means of a spring 195, in a position in which the push button 173 fully protrudes from the housing 183 of the release mechanism 142 and the end 189 of the locking pin 183 is engaged with the latch plate 136.

As shown in FIGS. 6 to 9, when the restrictor member 112 is engaged with the latch mechanism 114, the latch pin 130 is retained within the slot 151 by the second portion 145 of the latch plate 136. In this position, the second end 189 of the locking pin 183 is seated in the notch 141 of the latch plate 136 and, as such, the latch plate 136 is unable to rotate to the unlocked position.

To disengage the restrictor member 112 from the latch mechanism 114, a user must slide the slider 171 away from the button 173 and hold the slider 171 in a disengaged position. Whilst holding the slider 171 in this position the user must simultaneously depress the button 173. Pressing the button 173 rotates the lever 179 against the force of the spring 195 and pulls the locking pin 183 in a direction away from the latch plate 136. The end 189 of the locking pin 183 disengages from the notch 141 and the latch plate 136 rotates, under the force of the biasing means described above, into the unlocked position. The latch pin 130 can then be withdrawn from the slot 151.

Figure 7:
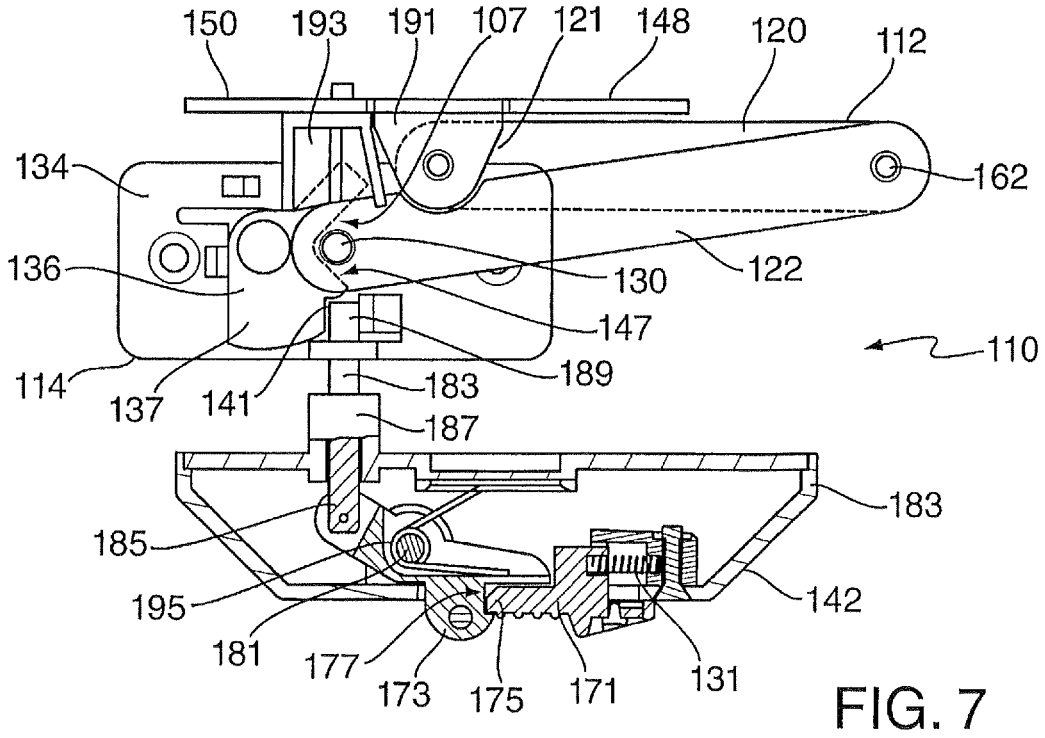
FIG. 7 is a partial cross-sectional view of the window restrictor of FIG. 6 in the engaged position.
Figure 8:
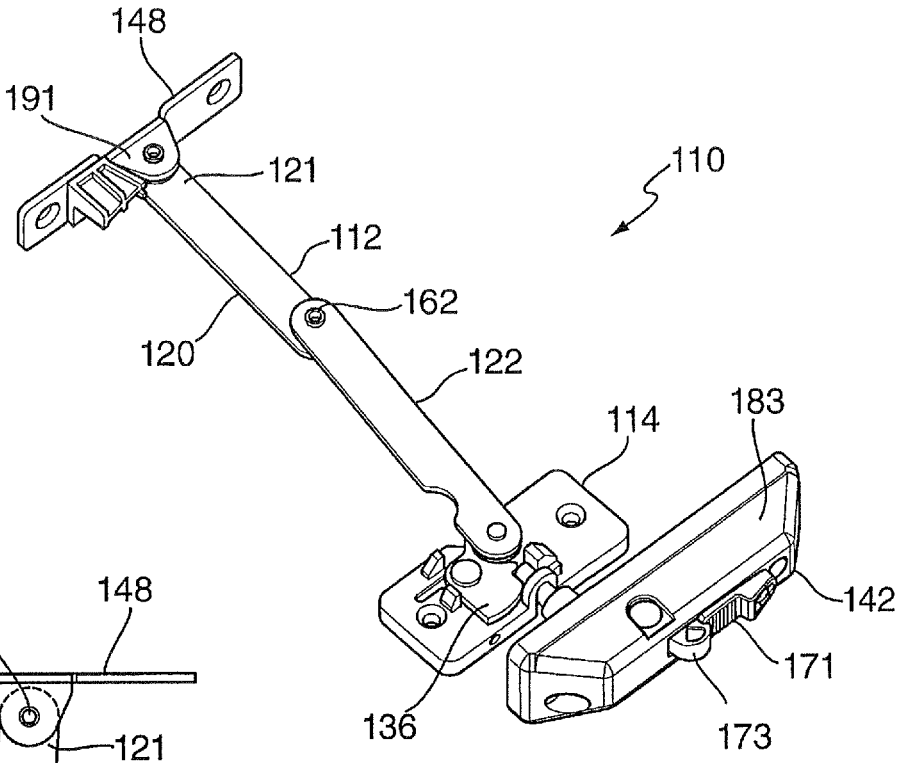
FIG. 8 is a perspective view of the window restrictor of FIG. 6 with a restrictor member in an extended position.
Figure 9:
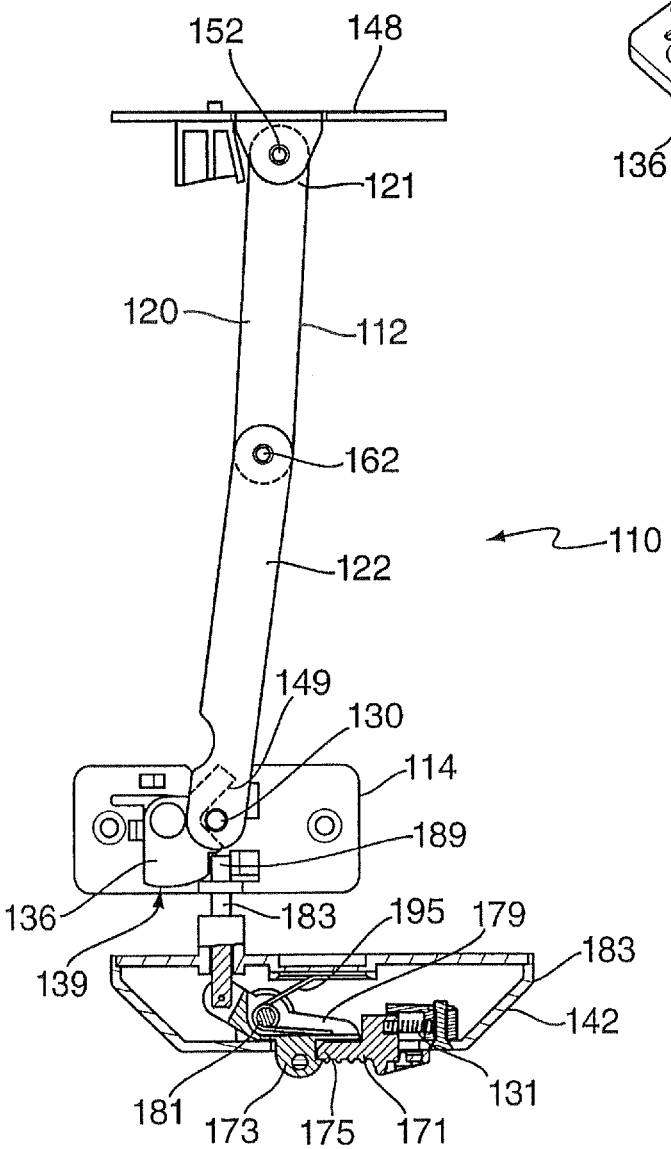
FIG. 9 is a partial cross-sectional view of the window restrictor of FIG. 8.

As shown in FIG. 7, the slider 171 prevents the button 173 from being pressed inwardly when the slider 171 is in an engaged position. Only when the slider 171 has been moved to a disengaged position can the button 173 be pushed inwardly.

In the disengaged position, as shown in FIGS. 10 and 11, the latch plate 136 remains in the unlocked position due to the action of the biasing means. In this position, the end 189 of the locking pin 183 is in contact with the cam surface 139 at an end of the cam surface 139 furthest from the notch 141. The dimensions of the latch plate 136 mean that the locking pin 183 is held in a retracted position, and the lever 179 remains rotated against the force of the spring 195. The button 173, therefore, remains depressed.

The restrictor member 112 preferably includes biasing means to return the first and second arms 120, 122 to the closed position as described in relation to the first embodiment. Preferably a first biasing means is located between the first and second arms 120, 122 proximate a pivot pin 162 and a second biasing means is located between the first arm 120 and the attachment means 148. When the latch pin 130 is released from the latch plate 136, the arms 120, 122 are released and spring, or retract, into a closed position adjacent the rail of the opening sash or casement window. In particular, the second arm 122 moves to a position in which it rests against the spacer block 193.

When the window is closed, the position of the latch pin 130 with the restrictor member 112 in the closed position is such that the latch pin 130 is aligned with the slot 151. Furthermore, the dimensions of the spacer block 193 are such that the second end 128 of the second arm 122 protrudes furthest from the window rail (not shown) allowing the latch pin 130 to engage cleanly with the latch mechanism 114. As the window is closed, the latch pin 130 automatically engages in the slot 151 and the continued movement of the window rail towards the window frame causes the latch pin 130 to push against the second edge 147 of the latch plate 136 and rotate the latch plate 136 about its pivot.

During the rotation of the latch plate 136, the end 189 of the locking pin 183 rides over the cam surface 139 until it is aligned with the notch 141. The spring 195 then causes the lever 179 to rotate to push the locking pin 183 forward to engage in the notch 141. Rotation of the lever 179 automatically causes the push button 173 to fully protrude from the housing 183 of the release mechanism 142, and the slider 171 is then urged against the button 173 by the spring 131 so that the first end 175 of the slider 171 engages with the indent 177 in the button 173.

In this embodiment, the latch mechanism 114 and the release mechanism 142 are formed as separate components of the window restrictor 110. This is so that the latch mechanism 114 may be attached on or in one side of a window frame, closest to the window pane to which the restrictor member 112 is attached, and the release mechanism 142 may be installed on or in the opposite side of the window frame. The locking pin 183 may then extend through a hole formed in the window frame between the latch mechanism 114 and the release mechanism 142.

This arrangement allows the window restrictor 110 to be installed so that, when the window is closed, only the push button 173 and slider 171 are visible from an interior side of the window, thereby improving the aesthetics of the assembly over prior art devices.

In addition, the use of a dual action button/slider mechanism that locates on an internal side of the window assembly allows a fly screen to be installed within the window cavity. The location of the dual action actuator thereby allows the user to disengage the window without having to remove the fly screen. This may be particularly advantageous when a movement mechanism is also used for moving the window without having to remove the fly screen. For example, the window assembly may include a rotatable handle which moves the window towards an open position. In this situation, the dual action actuator can also be operated without removing the fly screen in order to fully open the window beyond the usual restricted range.

In one alternative embodiment, the dual action actuator locates on the inside block so a user must open the window and remove any fly screen in order to operate the dual action actuator.

Furthermore, the present invention includes an aid to help with the reliable re-latching of the window restrictor 110. This helps the latching pin 130 to repeatably and reliably force the latch plate 136 to rotate on closing and for the window restrictor 110 to be reset. This aid comprises the spacer block 193. As previously explained, the spacer block 193 provides a stop against which the second arm 122 rests when the restrictor member 112 is in the closed position. However, in addition to this, the spacer block 193 is dimensioned to actually prevent any over rotation of the second end 128 of the second arm 122. If such over rotation occurs, then this may actually prevent the latch pin 130 and the latch plate from being fully engaged.

The frequency of such false latches may increase with use and wear and tear and the use of the spacer block 193 actually solves this particular problem. It can be seen on FIG. 7 and FIG. 11 that the spacer block 193 will provide a continuous surface through which to transmit and generate a reaction force in direct opposition to the closing force of the window. This prevents the pivot pins 152, 162 from solely being responsible for generating the reaction force.

The dimensions of the spacer block 193 may be varied depending upon the size of the window. Accordingly, the spacer block 193 may be removable and replaceable in order for the size of the spacer block 193 to be adjusted to suit the particular configuration of window.

Figure 12:
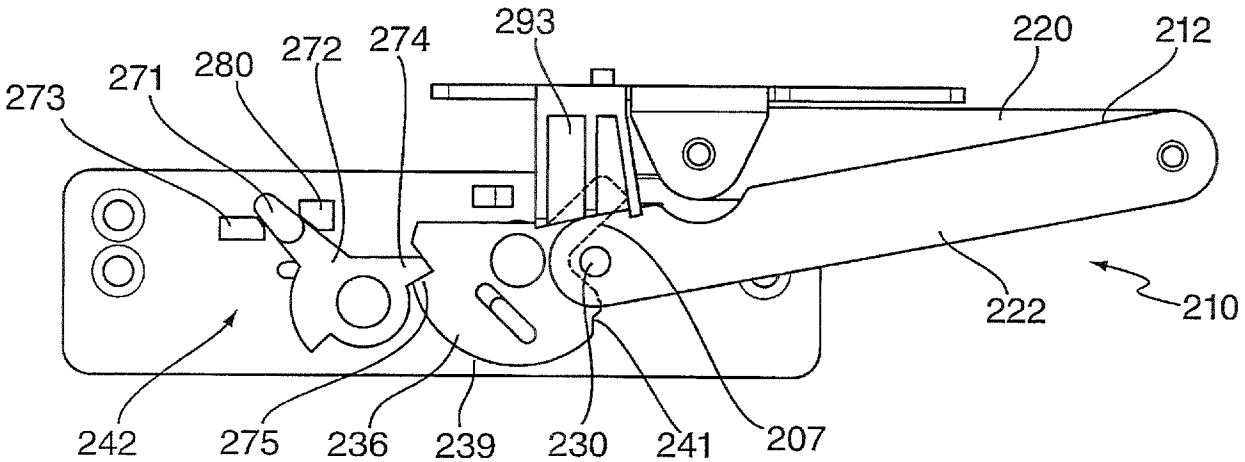
FIG. 12 is a plan view of a further embodiment of the present invention.

In a further embodiment of the present invention, the window restrictor 210 comprises a dual action release mechanism comprises a lever 271 and a sliding button 273 which must both be simultaneously operated in order to release the window for opening beyond the initial restricted opening distance, as shown in FIG. 12.

A release mechanism 242 comprises a slidably mounted trigger or slider 273 and a rotatable lever 271 that must be simultaneously activated by a user in order to disengage the restrictor member 212 from the latch mechanism. Accordingly, as in the earlier embodiments, the release mechanism requires a simultaneous dual action. In particular, a first end of the slider 273 engages with the lever 271 so that a user must first move the slider 273 in a direction away from the lever 271, possibly against the action of a spring (not shown) or other biasing means, before the lever 271 can be rotated. The lever comprises a rotating plate 272 including a projecting lug 274 which is arranged to engage within a recess 275 provided on the latch plate 236. The engagement of the projecting lug 274 within the recess 275 prevents the latch plate 236 from being rotatable and enabling the latch pin 230 to be disengaged.

To disengage the restrictor member 212 from the latch mechanism 214, a user must slide the slider 273 away from the lever 271 and hold the slider 273 in a disengaged position. Whilst holding the slider 273 in this position the user must simultaneously rotate the lever 271. The rotation of the lever 271 causes a rotation of the rotating plate 272 and this may be against the force of a spring (not shown) and moves the projecting (locking) lug 274 in a direction away from the latch plate 236. The projecting lug 274 disengages from the notch 275 and the latch plate 236 rotates, under the force of the biasing means described above, into the unlocked position. The latch pin 230 can then be withdrawn from the slot.

Accordingly, in this embodiment the slider 273 prevents the lever 271 from being rotated when the slider 273 is in an engaged position. Only when the slider 273 has been moved to a disengaged position can the lever 271 be rotated.

In this embodiment, the slider 273 can be replaced with a push button mechanism such that the push button prevent the lever 271 from being rotated and only when the push button is pressed can the lever 273 rotate to enable the disengagement mechanism.

It can be seen form FIG. 12 that the latch pin 230 will be automatically be re-engaged as described in relation to the previous embodiments. In particular, the latch pin causes a rotation of the latch plate 236 which rotates until the projecting lug 274 engages within the notch 275 in order to lock the latch plate in a closed and engaged configuration.

In this embodiment, since both the lever 271 and the slide button 273 are sprung, the original (closed/locked) position is automatically restored when the latch plate 236 is turned back to the locking position on closing the window. The mechanism includes a stopper or abutment member 280 which prevents the biasing means from over-rotating the lever 271 and keeps the lever in a rest position.

In the preferred embodiments of the present invention, the release mechanism cannot be activated when the window is closed. The latch plate will only move into the open position if there is some tension in the arms, i.e. the window is open by an amount.

In some embodiments, the slider/button may be hidden/concealed by the window when the window is closed and the window needs to be opened slightly before a user can actually operate the slider/button.

The invention claimed is:

1. A window restrictor for limiting an extent of opening of a window, the window restrictor comprising a restrictor member attachable to a first part of said window and a latch mechanism attachable to a second part of said window, the restrictor member comprising a first arm and a second arm, wherein the first arm comprises attachment means to rotatably attach the first arm to the first part of said window, the first arm being pivotally connected to the second arm and the second arm comprising a first locking means, the latch mechanism comprising second locking means for engagement with the first locking means, wherein, in use, when said first and second locking means are engaged, relative movement of said first and second window parts in a direction of opening is limited by said restrictor member, the window restrictor further comprising release means for disengaging said first and second locking means to enable the relative movement of said first and second window parts beyond a limit of the restrictor member and, when disengaged, the first and second locking means are aligned to automatically re-engage as said window is closed and wherein the release means comprises a simultaneous dual action release mechanism comprising a first actuator and a second actuator and wherein the first actuator is operated by a first manual action and the second actuator is operated by a second independent manual action and wherein the restrictor member comprises a spacer block in order to aid the latch mechanism and, in which, the spacer block is arranged to abut a part of the restrictor member and urge the first and second locking means to re-engage as the window is closed.

2. A window restrictor according to claim 1 in which the first actuator must be manually held in a disengaged position to enable the second actuator to move from an engaged position to a disengaged position.

3. A window restrictor according to claim 1 in which the first and second locking means are aligned to automatically re-engage when the first and second window parts are moved back to a reengagement position of the window restrictor.

4. A window restrictor according to claim 1 in which a first end of the first arm comprises the attachment means for rotatable attachment of the first arm to the first part of said window.

5. A window restrictor according to claim 4 in which the attachment means comprises biasing to bias the first arm towards a rest position and, in which, in the rest position, the first arm is aligned with and parallel to the first part of the window.

6. A window restrictor according to claim 1 in which the first arm and the second arm extend along respective longitudinal axes and wherein each longitudinal axis is parallel to the first part of the window in the rest position.

7. A window restrictor according to claim 1 in which the first arm and the second aim extend along respective longitudinal axes and wherein each longitudinal axis is parallel to the first part of the window when the first and second locking means are disengaged and the second part of the window is opened beyond the limit of the restrictor member.

8. A window restrictor according to claim 1 in which the first arm and the second arm locate adjacent to and flush with a mounting surface of the first part of the window when the first and second locking means are disengaged and the second part of the window is opened beyond the limit of the restrictor member.

9. A window restrictor according to claim 1 in which a second end of the first arm is pivotally connected by pivot means to a first end of the second arm.

10. A window restrictor according to claim 9 in which the pivot means comprises biasing to bias the second arm towards a rest position.

11. A window restrictor according to claim 1 in which in the released and disengaged configuration, the first arm and the second arm are urged into a position at which the first arm and the second arm do not project towards the second part of the window and do not extend into a space created by opening the window.

12. A window restrictor according to claim 1 in which the first arm and the second arm form a hinged member.

13. A window restrictor according to claim 1 in which the dual action release mechanism comprises an actuating mechanism which requires a simultaneous pull movement and a push movement.

14. A window restrictor according to claim 1 in which the second actuator is only operable once the first actuator has been operated.

15. A window restrictor according to claim 1 in which the first actuator must be held in a disengaged position to enable the second actuator to move from an engaged position to a disengaged position.

16. A window restrictor according to claim 1 in which the first actuator must be manually held in a disengaged position to enable the second actuator to move from an engaged position to a disengaged position.

17. A window restrictor according to claim 1 in which an actuating mechanism requires the first actuator to be moved which then allows the movement of the second actuator which then enables relative movement of the first and second window parts beyond the limit of the restrictor member.

18. A window restrictor according to claim 1 in which both of the dual actions required are achievable by a single hand of a user and the first actuator and the second actuator are both operable by a single hand of a user.

19. A window restrictor according to claim 1 in which the first locking means comprises a locking lug which is mounted on the second arm and the second locking means comprises a latching recess for receiving and retaining the first locking means and wherein the latching recess together with the latch mechanism encapsulates the first locking means in an engaged configuration.

20. A window restrictor according to claim 19 in which the latching recess encapsulates the first locking means in an engaged configuration and prevents any translational movement of the first locking means relative to the latching recess in an engaged configuration.

21. A window restrictor according to claim 1 in which the extent of the initial opening of the window is limited to a linear length of the first arm and the second arm.

22. A window restrictor according to claim 1 in which when the window restrictor is disengaged the first locking means and the second locking means are aligned such that as second part of the window is closed to a predetermined reengaging position the window restrictor is automatically reengaged without user intervention.

23. A window restrictor according to claim 22 in which the predetermined reengaging position comprises a position at which the first window part is located adjacent to the second window part.

24. A window restrictor according to claim 1 in which the window restrictor is arranged to for limit the extent of opening of a sash hingedly coupled to a window frame.

25. A window restrictor according to claim 1 in which when the window is in a closed position the locking means is engaged.

26. A window restrictor according to claim 1 in which, as the window is opened from the closed position the first locking means solely rotates and is prevented from translational movement relative to the second window part.

27. A window restrictor according to claim 1 in which, as the window is opened from the closed position the second locking means remains stationary relative to the second window part.

28. A window restrictor according to claim 1, wherein the spacer block is located and configured to limit a degree to which the first arm is free to rotate relative to the attachment means.

29. A window restrictor according to claim 28, wherein:

the attachment means comprises a base plate, the spacer block is located and configured to limit an extent to which the first arm is free to rotate relative to the base plate to approximately 90 degrees.

30. A window restrictor according to claim 1, wherein the spacer block is removable and replaceable, whereby the spacer block can be replaced with a replacement block that is of dimensions to suit a particular window configuration.

31. A window assembly including a window and a window restrictor for limiting an extent of opening of said window, the window restrictor comprising a restrictor member attachable to a first part of said window and a latch mechanism attachable to a second part of said window, the restrictor member comprising a first arm and a second arm, wherein the first arm comprises attachment means to rotatably attach the first arm to the first part of said window, the first arm being pivotally connected to the second arm and the second arm comprising a first locking means, the latch mechanism comprising second locking means for engagement with the first locking means, wherein, in use, when said first and second locking means are engaged, relative movement of said first and second window parts in a direction of opening is limited by said restrictor member, the window restrictor further comprising release means for disengaging said first and second locking means to enable the relative movement of said first and second window parts beyond a limit of the restrictor member and, when disengaged, the first and second locking means are aligned to automatically re-engage as said window is closed and wherein the release means comprises a simultaneous dual action release mechanism comprising a first actuator and a second actuator and wherein the first actuator is operated by a first manual action and the second actuator is operated by a second independent manual action and wherein the restrictor member comprises a spacer block in order to aid the latch mechanism and, in which, the spacer block is arranged to abut a part of the restrictor member and urge the first and second locking means to re-engage as the window is closed.

32. A window restrictor for limiting an extent of opening of a window, the window restrictor comprising a restrictor member attachable to a first part of said window and a latch mechanism attachable to a second part of said window, the restrictor member comprising a first arm and a second arm, wherein the first arm is rotatably attached to the first part of said window, the first arm is pivotally connected to the second arm and the second arm comprises a first locking element, the latch mechanism comprises a second locking element, wherein, in use, when said first locking element is engage with said second locking element, relative movement of said first and second window parts in a direction of opening is limited by said restrictor member, the window restrictor further comprising a release element that is configured to disengage the first locking element from the second locking element to enable relative movement of said first and second window parts beyond a limit of the restrictor member and, when disengaged, the first locking element and the second locking element are aligned to automatically re-engage as said window is closed and wherein the release element comprises a simultaneous dual action release mechanism comprising a first actuator and a second actuator and wherein the first actuator is operated by a first manual action and the second actuator is operated by a second independent manual action and wherein the restrictor member comprises a spacer block in order to aid the latch mechanism and, in which, the spacer block is arranged to abut a part of the restrictor member and urge the first locking element and the second locking element to re-engage as the window is closed.

33. A window assembly including a window and a window restrictor for limiting an extent of opening of said window, the window restrictor comprising a restrictor member attachable to a first part of said window and a latch mechanism attachable to a second part of said window, the restrictor member comprising a first arm and a second arm, wherein the first arm is rotatably attached to the first part of said window, the first arm is pivotally connected to the second arm and the second arm comprises a first locking element, the latch mechanism comprises a second locking element, wherein, in use, when said first locking element is engage with said second locking element, relative movement of said first and second window parts in a direction of opening is limited by said restrictor member, the window restrictor further comprising a release element that is configured to disengage the first locking element from the second locking element to enable relative movement of said first and second window parts beyond a limit of the restrictor member and, when disengaged, the first locking element and the second locking element are aligned to automatically re-engage as said window is closed and wherein the release element comprises a simultaneous dual action release mechanism comprising a first actuator and a second actuator and wherein the first actuator is operated by a first manual action and the second actuator is operated by a second independent manual action and wherein the restrictor member comprises a spacer block in order to aid the latch mechanism and, in which, the spacer block is arranged to abut a part of the restrictor member and urge the first locking element and the second locking element to re-engage as the window is closed.

* * * * *

UNITED STATES PATENT AND TRADEMARK OFFICE

CERTIFICATE OF CORRECTION

PATENT NO. : 8,726,572 B2
APPLICATION NO. : 13/627341
DATED : May 20, 2014
INVENTOR(S) : Michael Derham It is certified that error appears in the above-identified patent and that said Letters Patent is hereby corrected as shown below:

In the Specification:

Column 1, line 49

Please correct: “and, - when” to -- and, when --

Column 6, line 11

Please replace: “and. in” with -- and, in --

In the Claims:

Column 16, line 57 (claim 7)

Please change: “aim” to -- arm --

Column 17, line 57 (claim 22)

Please add: “the” before -- second --

Signed and Sealed this
Fifth Day of August, 2014

Michelle K. Lee

Michelle K. Lee
*Deputy Director of the United States Patent and Trademark Office*